United States Patent [19]

Schulz

[11] Patent Number: 4,462,291

[45] Date of Patent: Jul. 31, 1984

[54] PUNCHING OR PRESSING MACHINE

[76] Inventor: Jürgen Schulz, Bergiusstrasse 32-34, Berlin 44, Fed. Rep. of Germany, D-1000

[21] Appl. No.: 249,378

[22] Filed: Mar. 31, 1981

[30] Foreign Application Priority Data

Mar. 31, 1980 [DE] Fed. Rep. of Germany ..... 3012486

[51] Int. Cl.[3] ..... B26D 5/02; B26D 5/16

[52] U.S. Cl. ..... 83/368; 83/527; 83/627; 83/628; 83/640; 308/6 R

[58] Field of Search ..... 83/627, 628, 527, 613, 83/569, 566, 626, 625, 629, 368; 100/291, 292, 263; 72/478, 482, 452, 244; 308/3 A, 6 R, 235; 74/99, 55; 269/234

[56] References Cited

U.S. PATENT DOCUMENTS

| | | | |
|---|---|---|---|
| 631,137 | 8/1899 | Thurber | 83/627 |
| 3,029,677 | 4/1962 | Metzger | 83/640 |
| 3,161,449 | 12/1964 | Flom | 308/6 R |
| 3,706,251 | 12/1972 | Wheeler et al. | 83/640 |
| 3,913,438 | 10/1975 | Walters et al. | 83/627 |
| 4,342,449 | 8/1982 | Illmann et al. | 269/234 |

FOREIGN PATENT DOCUMENTS

| | | | |
|---|---|---|---|
| 15621 | of 1903 | United Kingdom | 72/244 |
| 780165 | 7/1957 | United Kingdom | 72/452 |

*Primary Examiner*—Frank T. Yost
*Assistant Examiner*—Hien H. Phan
*Attorney, Agent, or Firm*—Holman & Stern

[57] ABSTRACT

A machine for punching or pressing sheet material comprises a support base, a stationary machine member and a machine member which is rectilinearly displaceable relative thereto for the working movement. At least one such member is fitted with a tool and in order to produce the working movement, a wedge is displaceable transversely to the direction of the said movement in a reciprocatory manner by means of a drive provided between the base support, or a member connected thereto, and the displaceable machine member, or a member connected thereto. The load transmitting surfaces on the wedge and the load transmitting surfaces facing the same on the adjacent support base and displaceable member are formed by hardened body-surfaces.

14 Claims, 6 Drawing Figures

FIG.5
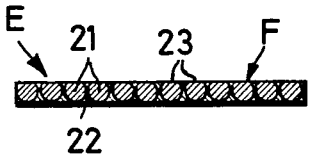
FIG.3
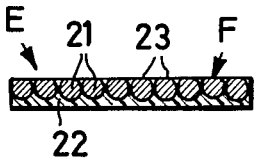
FIG.4
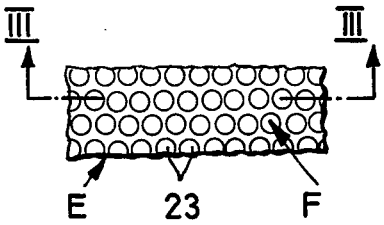
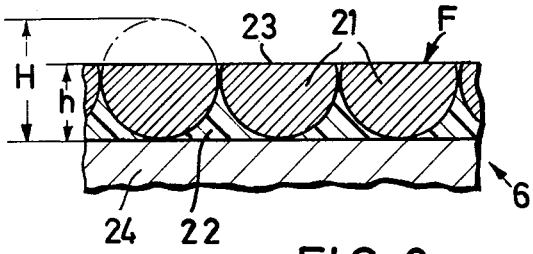
FIG. 6

PUNCHING OR PRESSING MACHINE

BACKGROUND OF THE INVENTION

1. Field of the Invention

The invention relates to a punching machine or press, in particular for punching flat articles out of web-like or sheet-like material, especially in the production of adhesive labels, having a support base or the like, a stationary machine member and a machine member which is displaceable relatively thereto in a rectilinear manner for the working movement, at least one of the aforesaid members being fitted with a tool, more particularly a cutting tool.

2. Description of the Prior Art

There are numerous instances in which treatment processes are to be performed by means of a tool which is displaceable rectilinearly towards a material to be treated and away from the latter, the requirement being in this case that the stroke, or the end position of the tool at the completion of the working stroke, respectively, must be maintained extremely accurately. This is true in particular for the production of adhesive labels. In that case, a self-adhesive layer and a web of work material from which the labels are to be manufactured are located on a supporting web of paper or a synthetic resin. When the label shape is being punched out, only this web of work material with the layer of adhesive is to be punched through, but not the supporting web. Because of the extraordinarily small thickness of such a web, maintaining this requirement has heretofore caused great difficulties. The example stated represents in this case other cases in which likewise high accuracy in a treatment operation with a rectilinearly displaced tool is important.

SUMMARY OF THE INVENTION

It is an object of the invention to overcome existing drawbacks, disadvantages and difficulties and to provide a punching machine, press or the like, by means of which high accuracy demands in respect of the work process may be fulfilled in an advantageous and relatively simple manner. At the same time the invention aims also at an advantageous construction of the apparatus in detail and of the elements associated therewith. Further problems with which the invention is concerned, are clear from the respective explanation of the solution provided.

The invention is characterized in that for the purpose of producing the working movement, a wedge is displaceable transversely to the direction of the said movement in a reciprocatory manner by means of a drive provided between the base support, or a member connected thereto, and the displaceable machine member, or a member connected thereto, and that the load transmitting surfaces on the wedge and the load transmitting surfaces facing the same on the adjacent support base and displaceable member are formed by hardened body-surfaces.

Owing to the fact that the movement surfaces, are formed by the hard body-surfaces details of which are explained hereinafter, it is possible to provide a displaceable wedge for producing the working movement. The hard body-surfaces may be produced with an accuracy and flatness such that thereby in co-operation with the wedge, high precision in the machine and thus also high operating accuracy is obtained.

The hard body-surfaces may slide directly one upon the other. Preferably, however, anti-friction means such as bearings are provided between the movement surfaces, in particular a needle bearing or the like, with corresponding races of a synthetic resin, such as are known per se, so that no sliding friction is present.

In the invention it is unnecessary to provide work materials which can be hardened, for the co-operating parts, for example for the wedge body and for the displaceable machine member. On the contrary, other and above all light work materials may also be used for this purpose. Thus, according to a feature of the invention, the wedge and/or the displaceable machine member may consist even of aluminum or an alloy of light metal, this having the advantage that the weight of the masses to be displaced is reduced.

In a further embodiment of the machine the invention provides that the tool at the member supporting it is likewise fastened to a hard body-surface and/or that the machine member lying opposite the tool is also formed by a hard body-surface. This contributes further to increasing the accuracy of the machine and the working of the same. A cam drive, e.g. an eccentric drive, may advantageously be provided for the reciprocatory displacement of the wedge.

Advantageously an adjusting device is allocated to the displaceable machine member. This may be so constructed in a particularly advantageous manner that it is displaceable parallel to the direction of movement of the wedge body for the purpose of its accurate adjustment and is displaced thereby in the direction of the working movement. In particular an eccentric drive may serve for the adjustment.

BRIEF DESCRIPTION OF THE DRAWINGS

Further details, features and advantages of the invention should become clear from the following explanation of constructional examples and from the accompanying drawings wherein;

FIG. 3 is a cross-sectional view through a hard body-surface taken on line III—III of FIG. 4, FIG. 4 is a plan view of a portion of the hard body-surface, FIG. 5 is a cross-sectional view corresponding to FIG. 3, showing a modified embodiment, and FIG. 6 is a cross-sectional view of a hard body-surface as shown in FIG. 3 on an enlarged scale.

DETAILED DESCRIPTION

Figure 1:
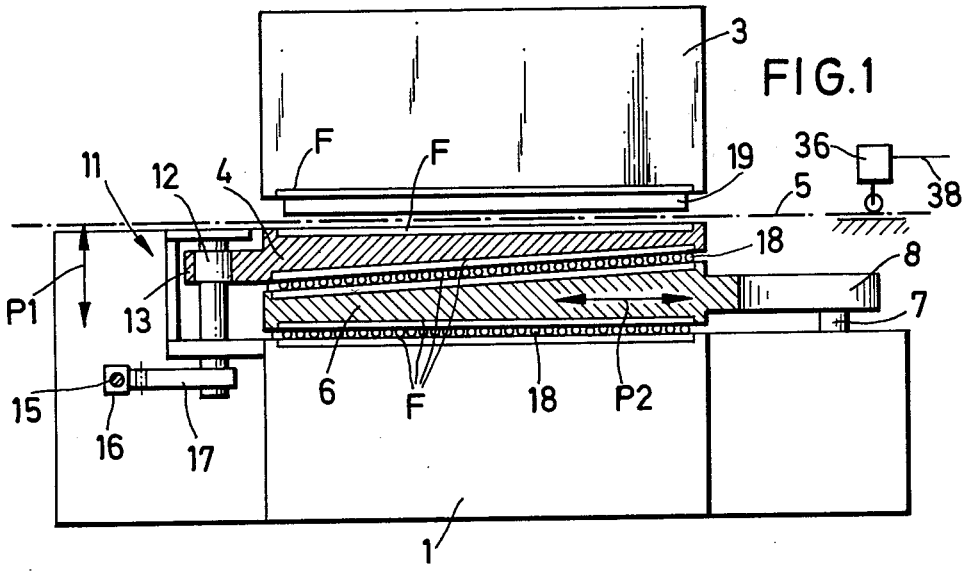
FIG. 1 is a partly cross-sectional view of the machine according to the invention taken on line I—I in FIG. 2.
Figure 2:
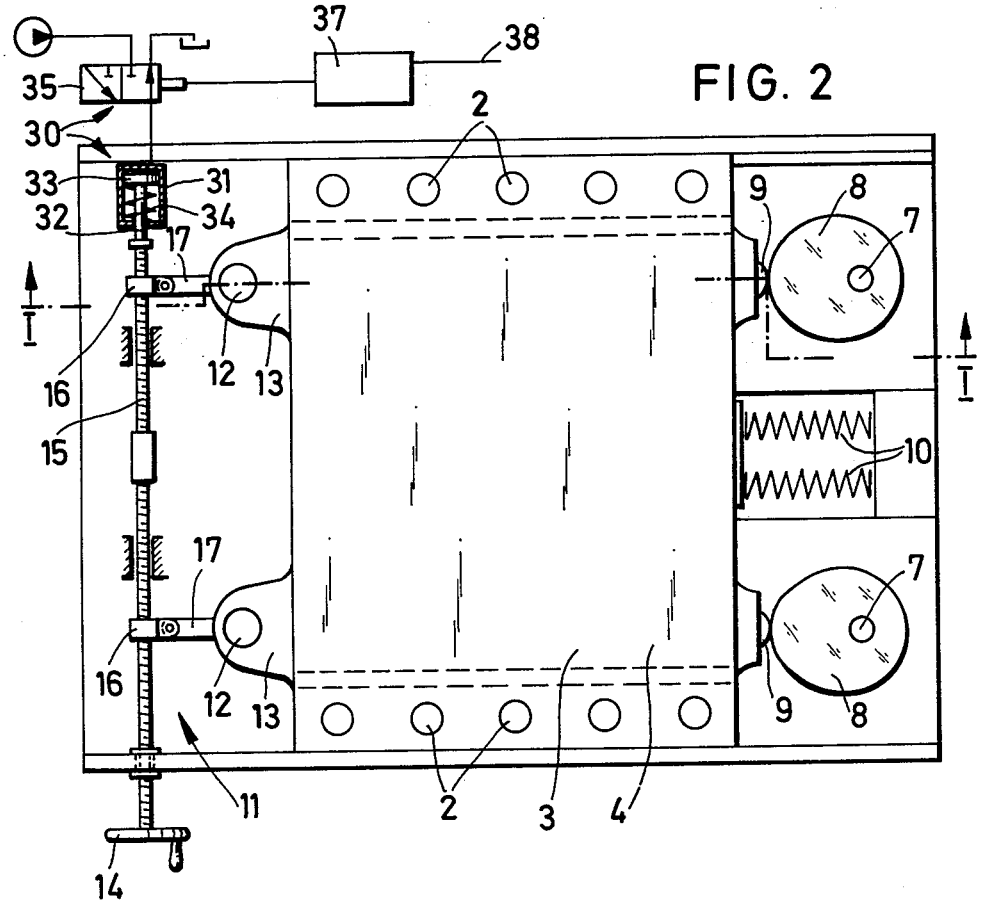
FIG. 2 is a top plan view of the machine of the invention.

The machine shown in FIGS. 1 and 2 comprises support base 1, a tool head 3 securely fastened to the base by a series of bolts 2 or other appropriate rigid connecting elements, and a member or bed 4 which is vertically displaceable relative to the tool head 3 in the direction of the arrow P1 in FIG. 1. Thus the bed 4 performs a movement such as required for performing a pressing, cutting, stamping or punching process. In particular the machine is suitable for punching parts out of an intermittently moved sheet or web 5; in this case there may in particular be a composite web comprised of a self-adhesive layer surmounted by an upper layer of paper or a synthetic resin serving for forming labels or similar elements and a support web for the adhesive and upper layers. In this case the punch cut is intended to sever solely the web which forms the labels and under certain circumstances the adhesive layer, but not the supporting web. This requires extremely accurate operation of the machine.

For the purpose of producing the working movement of the displaceable member or bed 4, there is a wedge 6 which is displaceable back and forth through a given and preferably adjustable path in the direction of the arrow P2 (FIG. 1) by a drive means. In this case the wedge 6 is supported by a horizontal undersurface on the support base 1 and its upper inclined surface causes the vertical displacement of the bed 4 the underside of which has a corresponding inclined surface. In the illustrated constructional example the drive means for the displacement of the wedge 6 comprises two cams 8 which are rotatable in the same direction about the shafts 7 the peripheral surfaces of which engage bearing members 9 on the wedge 6. Tension springs 10 or other suitable elements serve for holding the bearing members 9 in continuous firm abutment with the cams 8 during their rotation. The cams 8 are both driven by a motor (not illustrated) which is located in the support base 1 and the rotary speed of which is variable or controllable.

In order to permit the height of the displaceable bed 4 to be adjusted accurately relative to the stationary work head 3, depending upon what material is to be treated, there is an adjusting device 11 which comprises two eccentrics 12 contained in bores formed in extensions 13 of the displaceable table 4. By simultaneous rotation of these eccentrics 12 the displaceable bed 4 is displaced horizontally relative to the wedge 6 by a corresponding amount whereby the latter experiences at the same time lowering or lifting in consequence of the inclined surfaces. This adjustment is very sensitive because of the mechanical interaction of the inclined surfaces. The simultaneous rotation of the eccentrics 12 may be effected by means of a screw-threaded spindle 15 which is mounted in the base of the apparatus and is rotatable by means of a hand wheel 14; the screw-threaded spindle 15 carries two nuts 16 which are pivotally connected to the levers 17 connected to the eccentrics 12.

The surfaces referred to as movement surfaces, i.e. the upper surface of the support base 1 in the region of the wedge 6, the underside and the upper side of the wedge 6 and the inclined underside of the displaceable bed 4 are formed by hard surfaces F between which anti-friction means such as needle bearings 18 or other anti-friction bearings suitable for rectilinear movements are located.

As a feature of the invention the hard surfaces F themselves are constructed as illustrated in FIGS. 3 to 6. In the embodiment of FIGS. 3 and 4, balls 21 having the same shape and size, and a hardness of for example from 65 to 68 Rockwell C, are held in a solidified embedding mass 22 of, for example, an epoxy resin or a polyester resin, under certain circumstances with the addition of bronze powder or steel powder. In this instance ball bearings may be involved. After the embedding mass has set, these ball bearings are ground away for a portion of their height so that there are obtained a multitude of mutually adjacent end faces 23 (FIG. 4) which in their totality form the hard surface F of the element E.

In the embodiment of FIG. 3, a region formed by the embedding mass under the balls 21 is still present with a height which may be selected in accordance with the respective requirement.

Such a lower region is absent from the embodiment of FIG. 5 which otherwise corresponds to that of FIGS. 3 and 4 and in which the component parts are denoted by the same reference numerals.

An element E of the kind explained above may be fixed to adjacent members of the apparatus for instance by adhesive attachment or even by clamping or in any other suitable manner.

Instead of being constituted by inserting a prefabricated element, each of the hard surfaces F may alternatively be produced directly on the members 4 and 6 or 1 and 3, respectively. If for example FIG. 6 is regarded as a section through the upper side of the wedge 6 along the center plane of the embedded, balls, it may be seen that the balls 21 are supported on the bottom 24 of a recess of the wedge 6 and are surrounded by an embedding mass 22. After the latter has hardened the balls have been reduced from their original height H (diameter) to their final height h by grinding or some other treatment process. Thereby in toto the hard surface F is obtained from the multitude of the individual end faces of these reduced balls 21; the intervening regions of the embedding mass which still appear on the upper surface are small in this case. This is illustrated in FIG. 6 in an enlarged view for greater clarity. The removed height H−h may lie in particular in the region of from 25% to 50%.

It has been found that the hard surfaces F can be produced with extremely high precision and high accuracy of shape, i.e. flatness, so that in conjunction therewith an advantageous production of the working movement in apparatus of the kind under discussion and a high working accuracy of the apparatus itself is obtained. Therefore even extremely difficult treatment problems may be overcome by means of such apparatus, such as inter alia punching through or severing a portion of a web of thin material.

In an advantageous further embodiment of the apparatus the member supporting the tool, in the present case the stationary head 3, is also equipped with a hard body-surface F of the above explained kind, so that the attachment or fixing of the tool, for example a steel strip cutting tool 19 is possible with high accuracy.

Furthermore even the member lying opposite the tool, in the present case the displaceable bed 4, is advantageously formed on its side facing the tool with a hardened surface F. During the performance of a punching process, a cover of copper, brass or the like may be disposed on the same.

Owing to the arrangement of the hard surfaces F it is otherwise unnecessary to construct certain parts of the apparatus, for example the wedge 6, from a work material of increased hardness of strength. On the contrary, especially the wedge body and/or the displaceable member may alternatively consist of a non-ferrous work material, preferably a light metal such as for example aluminum or an aluminum alloy. Thereby inter alia the inertia forces may also be reduced during operation.

In a further advantageous embodiment the apparatus illustrated in FIGS. 1 and 2 is equipped with a rapid adjustment device 30 for the displaceable machine member 4. This renders it possible upon a given command to lower the displaceable machine member 4 independently of its adjustment or alignment for the operating process, by an amount such that during the reciprocatory movement of the wedge 6 the machine member 4 vertically reciprocated by the latter as before lies so low in the upper reversal point of its working movement that the web of material 5 is no longer punched or cut by the tool 19. This may be of advantage in several instances, e.g. when an end of a web 5 is connected to the beginning of new web by adhesive joining or the like and therefore twice the thickness results due to the overlap; this may result that at this location not only an upper layer of the web intended for example for labels is severed, but also one of the support layers.

The rapid adjustment device may be formed in various ways. All constructions are within the scope of the invention by means of which the explained effect may be obtained, in particular by means of a displacement of the displaceable member or bed 4 parallel to the direction of the arrow P2. There may be provided a device which is independent of an adjusting device or one which is combined with the latter. This is illustrated in the constructional example. The screw-threaded spindle 15 of the adjusting device 11, together with the nuts 16, is displaceable in an axial direction by a sufficient amount, for example by means of a pressure medium cylinder 31, wherein the piston rod 32 of the piston 33 displaceable therein is coupled to the screw-threaded spindle 15 by way of a connection which permits rotation of the latter. In the illustrated position the piston 33 has an end position which is accurately defined by an abutment, whereby the adjustment effected by means of the hand wheel 14 and the accurate working position of the displaceable machine member 4 is secured. The piston 33 may be retained in this position by the effect of the pressure medium or by a strong spring 34.

The piston 33 may be extended from this position by its total stroke or merely by a portion thereof by supplying to the cylinder 31 a pressure medium through a valve 35, whereby it displaces the screw-threaded spindle 15. Thereby the eccentrics 12 are rotated by way of the levers 17 in such a manner that the displaceable machine member 4 experiences displacement, in FIG. 1 to the left, of a magnitude such that during the reciprocatory movement of the wedge body 6 it is lifted vertically only by such an amount still that the tool 19 cannot cut the web 5 any more. By change-over of the valve 35 and the removal effected thereby of the pressure in the cylinder 31 the piston 33 and all the members connected with it return to the starting position, so that the apparatus continues to work normally.

The actuation of the valve 35 may be effected manually at the respective desired instant of time, and furthermore also by a program or more particularly dependent upon the response of a sensor 36 scanning the web 5 (FIG. 1): for example the sensor 36 may be in a position to detect a thickened part of the passing web and may otherwise be constructed in a manner known to the expert. In FIG. 2 there is shown a control device 37 which, in response to signals delivered by the sensor 36, initiates the actuation of the valve. By means of such a sensor 36 the valve 35 may be actuated more particularly even with a delay which is effected by a delay member in the control device 37 and which has been just so selected that the displaceable machine member or bed 4 is adjusted for suppression of a cutting process by means of the device 30, when the respective location of the intermittently displaced web is located under the tool 19. By ensuing control or in any other suitable manner the member 4 may be returned again immediately thereafter by the device 30, so that the next following working stroke is performed again normally. Correspondingly suppression of the cutting process, if so required, is also possible for a plurality of strokes.

I claim:

1. In a punching or pressing machine for punching or pressing sheet material having a support base, a stationary machine member rigidly attached to said base, a movable machine member supported between said base and stationary member for reciprocating movement with respect thereto, a punching or pressing tool mounted on at least one of said stationary or movable machine members, a wedge shaped member mounted between said support base and said movable machine member for reciprocating movement in a direction substantially transverse to the reciprocating movement of said movable member so that movement of said wedge member produces said reciprocating movement of said movable member, drive means operably connected between said support base and said wedge member to reciprocate said wedge member relative to said support base and said movable member, and hardened load bearing surfaces on the faces of said wedge member and the adjacent cooperating faces of said support base and movable member, the improvement comprising, all said load bearing surfaces have substantially the same area, and each said surface is a hardened body-surface comprised of a layer of closely spaced hard bodies having a circular cross-sectional shape embedded in a matrix of solidified synthetic resin, the outer surface of said layer being flat and formed by flat coplanar faces of said hard bodies and matrix, said flat faces of said hard bodies being substantially circular in shape and positioned inwardly from the original outer surface thereof 25% to 50% of the diameter of said cross-section.

2. A machine according to claim 1 and further comprising anti-friction bearings between the relatively movable load bearing surfaces on said wedge member, support base and movable member.

3. A machine according to claim 1 wherein the member on which said tool is mounted is provided with a said hardened body-surface.

4. A machine according to claim 1, wherein the surface of the machine member on which the punching or pressing tool is not mounted is provided with a said hardened body-surface.

5. A machine according to claim 1 wherein said drive means comprises a cam drive means for causing reciprocatory displacement of the wedge member.

6. A machine as claimed in claim 5 wherein said cam drive means comprises at least one cam member rotatably and eccentrically mounted on said support base and having a peripheral camming surface thereon, at least one cam follower mounted on said wedge member to operatively engage said peripheral camming surface, and spring means connected to said support base and said wedge member to resiliently urge said cam follower into engagement with said camming surface.

7. A machine according to claim 1 wherein said wedge shaped member comprises a non-ferrous material and said hard bodies are steel.

8. A machine according to claim 1 wherein said movable machine member comprises a non-ferrous material and said hard bodies are steel.

9. A machine as claimed in claim 1 wherein said hard bodies are spherical in shape and are arranged in substantially abutting and substantially coplanar relationship with respect to each other.

10. A machine according to claim 1, and further comprising adjustment means to adjust said movable machine member parallel to the direction of movement of the wedge member, wherein said adjustment means comprises an eccentric adjusting means operatively connected between said support base and said movable member, and means for rotating the said eccentric adjusting means.

11. A machine as claimed in claim 10 wherein said eccentric adjusting means comprises at least one bore hole in said movable member, a circular cam member rotatably mounted in said bore hole, a shaft fixedly attached to said cam member, a lever fixedly attached adjacent one end thereof to said shaft and pivotally connected adjacent the other end to an internally screw-threaded member, an elongated externally screw-threaded spindle operatively engaging said screw-threaded member and rotatably mounted on said support base, and a means for rotating said spindle to operate said lever to thereby adjust said movable member.

12. A machine as claimed in claim 11, and further comprising a fluid operated means to rapidly adjust said movable member comprising, a piston and cylinder means, and valve means operatively connected to said piston and cylinder means to control the operation thereof, said piston being operatively connected to said screw-threaded spindle for moving said spindle in the directiion of its longitudinal axis.

13. A machine as claimed in claim 12 and further comprising a sensing means operatively associated with said sheet material to detect changes in the thickness thereof and operable to emit a signal indicating said change in thickness, and operatively connected to said fluid pressure operated means to control it by said signal.

14. In a punching or pressing machine for punching or pressing sheet material having a support base, a stationary machine member rigidly attached to said base, a movable machine member supported between said base and stationary member for reciprocating movement with respect thereto, and a punching or pressing tool mounted on at least one of said stationary or movable machine members, a wedge shaped member mounted between said support base and said movable machine member for reciprocating movement in a direction substantially transverse to the reciprocating movement of said movable member so that movement of said wedge member produces said reciprocating movement of said movable member, drive means operably connected between said support base and said wedge member to reciprocate said wedge member relative to said support base and said movable member, and hardened load bearing surfaces on the faces of said wedge member and the adjacent cooperating faces of said support base and movable member, the improvement comprising an eccentric drive adjustment means operatively connected between said support base and said movable member to adjust said movable machine member parallel to the direction of movement of said wedge comprising, at least one bore hole in said movable member, a circular cam member rotatably mounted in said bore hole, a shaft fixedly attached to said cam member, a lever fixedly attached adjacent one end thereof to said shaft and pivotally connected adjacent the other end to an internally screw-threaded member, an elongated externally screw-threaded spindle operatively engaging said screw-threaded member and rotatably mounted on said support base, and a means for rotating said spindle to operate said lever to thereby adjust said movable member.

* * * * *